US009177739B2

(12) United States Patent
Miller

(10) Patent No.: US 9,177,739 B2
(45) Date of Patent: Nov. 3, 2015

(54) SCALABLE MEDIUM VOLTAGE LATCHING EARTHING SWITCH

(75) Inventor: David D. Miller, Kitchener (CA)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 1037 days.

(21) Appl. No.: 13/096,166

(22) Filed: Apr. 28, 2011

(65) Prior Publication Data

US 2012/0273333 A1 Nov. 1, 2012

(51) Int. Cl.

| | |
|---|---|
| ***H01H 5/00*** | (2006.01) |
| ***H01H 31/00*** | (2006.01) |
| *H01H 1/22* | (2006.01) |
| *H01H 1/42* | (2006.01) |
| *H01H 1/44* | (2006.01) |
| *H01H 31/28* | (2006.01) |

(52) U.S. Cl.

CPC ..... *H01H 31/003* (2013.01); *H01H 1/42* (2013.01); *H01H 1/44* (2013.01); *H01H 31/28* (2013.01); *H01H 2001/223* (2013.01)

(58) Field of Classification Search

CPC ..... H01H 31/003; H01H 31/28; H01H 1/42; H01H 1/44; H01H 1/2058; H01H 1/221; H01H 2001/223; H01H 1/225; H01H 2001/228

USPC ..... 200/400

See application file for complete search history.

(56) References Cited

U.S. PATENT DOCUMENTS

| | | | | |
|---|---|---|---|---|
| 2,820,862 | A | 1/1958 | Carmichael et al. | |
| 5,650,603 | A | 7/1997 | Pfaff et al. | |
| 5,926,081 | A * | 7/1999 | DiMarco et al. | 335/16 |
| 6,369,340 | B1 * | 4/2002 | Castonguay et al. | 200/244 |
| 6,459,059 | B1 * | 10/2002 | Greenberg et al. | 200/401 |
| 8,039,770 | B2 * | 10/2011 | Schaltenbrand et al. | 200/400 |

FOREIGN PATENT DOCUMENTS

| | | |
|---|---|---|
| DE | 41 03 101 A1 | 9/1991 |
| DE | 19619451 | 11/1997 |

OTHER PUBLICATIONS

European Search Report dated Aug. 2, 2012 for European Application No. EP 12 16 5701.

European Office Action, dated Jan. 7, 2014, in connection with Appln. No. EP12165701.9.

* cited by examiner

*Primary Examiner* — Renee Luebke
*Assistant Examiner* — Lheiren Mae A Caroc
(74) *Attorney, Agent, or Firm* — Fay Sharpe LLP

(57) ABSTRACT

A scalable earthing switch that incorporates a torsion spring to effect rapid closure of the switch. The torsion spring is supported coaxially about a rotatable shaft on which contact blades are mounted resulting in compact design. The blade contacts are separated axially along the length of the shaft by one or more spacers. By using difference size spacers the distance between adjacent blade contacts can be changed and, thus, the earthing switch can be easily scaled for different applications. A latching (detent) mechanism is provided for latching the switch in an open position.

16 Claims, 8 Drawing Sheets

SCALABLE MEDIUM VOLTAGE LATCHING EARTHING SWITCH

BACKGROUND

The present exemplary embodiment relates to electrical switching mechanisms. It finds particular application in conjunction with medium voltage earthing switches, and will be described with particular reference thereto. However, it is to be appreciated that the present exemplary embodiment is also amenable to other like applications.

It is common to provide protection to technicians servicing an electrical component enclosure through the provision of an earthing switch. A typical earthing switch includes one or more blade contacts mounted on a rotatable shaft. An actuating mechanism rotates the shaft to move the blade contacts between an open position and a closed position in contact with a grounding electrode. The earthing switch is typically installed between a distribution bus and a circuit breaker connecting the distribution bus to a main line. The earthing switch, when closed, grounds the distribution bus.

Prior to earthing the line or bus terminals, it is typical to disconnect the upstream source of electrical power. In certain situations, however, the circuit may inadvertently be live during grounding. In other situations, the upstream source of electrical power may be inadvertently reenergized before performing closing of the switch. In still other situations, there could be back feed of electricity to the distribution bus such as, for example, in the case of a spinning electric motor producing current that back feeds to the distribution bus. Thus, even when the circuit breaker connecting the distribution bus to the main bus is open, current may exist in the distribution bus. In each of the foregoing situations, a properly operating earthing switch can protect technicians and equipment from harm.

Arcing can occur when an earthing switch is closed on a fault. The arcing, in turn, can cause melting of the contact material which can result in welding of the contacts. If the contacts are not opened while the metal is still fluid, a rough surface is produced. The voltage concentrations caused by the spikes on the now rough surface result in an even earlier striking of the arc the next time and can lead to permanent welding of the contacts.

To minimize arcing, many conventional earthing switches include coil springs configured to rapidly close the switch when actuated. Such coil springs are often supported adjacent to the rotatable shaft and operatively coupled to the shaft by a crank arm or other mechanism. When the switch is actuated to close, the spring is configured to act on the crank arm to rapidly rotate the shaft and thereby quickly close the switch.

Current earthing switch designs relying on coil springs are generally bulky since the coil springs and associated mechanisms are supported adjacent the rotating shaft and blade contacts. Further, such prior art earthing switches are not easily scalable to various applications, since most often the blade contacts are welded or otherwise permanently secured to the rotatable shaft. Thus, separate shaft/blade assemblies typically need to be manufactured for different applications.

BRIEF DESCRIPTION

The present disclosure provides a scalable earthing switch that incorporates a torsion spring to effect rapid closure of the switch. The torsion spring is supported coaxially about a rotatable shaft on which contact blades are mounted resulting in a more compact design. The blade contacts are separated axially along the length of the shaft by one or more spacers.

By using difference size spacers the distance between adjacent blade contacts can be changed and, thus, the earthing switch can be easily scaled for different applications. A latching (detent) mechanism is provided for latching the switch in an open position.

In accordance with one aspect, an earthing switch for a connecting a power source to ground comprises an actuating mechanism, a rotatable shaft adapted to be rotated by the actuating mechanism, at least one moveable contact secured to the rotatable shaft for movement therewith between an open position and a closed position, a torsion spring for biasing the at least one moveable contact towards the closed position, and a detent mechanism for latching the at least one moveable contact in the open position.

The switch can further include a plurality of moveable contacts secured to the rotatable shaft for movement therewith, the moveable contacts being axially spaced apart along the shaft by at least one spacer. The at least one spacer can be coaxially received over the rotatable shaft, and may be conductive. The at least one moveable contact can include a pair of spaced apart blades adapted to receive a stab therebetween when in the closed position. The at least one moveable contact can include a non-circular bore adapted to be received on a non-circular section of the shaft for fixing the contact for rotation therewith. The actuating mechanism can include a rotary actuating mechanism for rotating the shaft.

The earthing switch can further comprise a mounting bracket, wherein the rotatable shaft is supported on the mounting bracket for rotation, and wherein a coil of the torsion spring is received coaxially over the rotatable shaft, a first end of the torsion spring being engaged with said mounted bracket, and a second end of the torsion spring being operatively connected to the movable contact, whereby rotation of the rotatable shaft in a first direction is opposed by the torsion spring while rotation of the rotatable shaft in the second direction is assisted by the torsion spring.

The detent mechanism can include at least one pawl adapted to engage a surface of a hub associated with the actuating mechanism for latching the switch in an open position. The at least one pawl can be pivotally mounted to a housing of the actuating mechanism for movement between a radially outer position and a radially inner position relative to the hub whereat the pawl is received in a recess in the hub thereby latching the switch open. A cam member can be provided for radially displacing the at least one pawl from its radially inner position, and the hub and cam can be mounted coaxially on an input shaft of the actuating mechanism whereby rotation of the input shaft from a position corresponding to a latched position of the switch towards a position corresponding to a closed position of the switch causes the cam to radially outwardly displace the at least one pawl from the recess and allow the switch to close.

In accordance with another aspect, a modular earthing switch assembly comprises a support member, a rotatable shaft having a non-circular cross-section supported for rotation on said support member, a moveable contact mountable on the rotatable shaft in a plurality of positions, the moveable contact having a bore with a non-circular cross-section for telescoping over the non-circular cross-section of the rotatable shaft thereby fixing the movable contact for rotation with the rotatable shaft, and at least one spacer received coaxially on the rotatable shaft and located adjacent the moveable contact, the at least one spacer axially locating the moveable contact along the rotatable shaft.

The switch can further include a torsion spring for biasing the movable contact towards a closed position. A mounting bracket can be provided, wherein the rotatable shaft is supported on the mounting bracket for rotation, and wherein a coil of the torsion spring is received coaxially over the rotatable shaft, a first end of the torsion spring being engaged with said mounted bracket, and a second end of the torsion spring being operatively connected to the movable contact, whereby rotation of the rotatable shaft in a first direction is opposed by the torsion spring while rotation of the rotatable shaft in the second direction is assisted by the torsion spring. The at least one moveable contact can include a pair of spaced apart blades adapted to receive a stab therebetween when in the closed position.

The switch can also include an actuating mechanism for rotating the shaft to effect movement of the at least one movable member between an open position and a closed position. A detent mechanism can be provided including at least one pawl adapted to engage a surface of a hub associated with the actuating mechanism for latching the switch in an open position. The at least one pawl can be pivotally mounted to a housing of the actuating mechanism for movement between a radially outer position and a radially inner position relative to the hub whereat the pawl is received in a recess in the hub for latching the switch open. A cam member can be provided for radially displacing the at least one pawl from its radially inner position, and the hub and cam can be mounted coaxially on an input shaft of the actuating mechanism whereby rotation of the input shaft from a position corresponding to a latched position of the switch towards a position corresponding to a closed position of the switch causes the cam to radially outwardly displace the at least one pawl from the recess and allow the switch to close.

DETAILED DESCRIPTION

Figure 1:
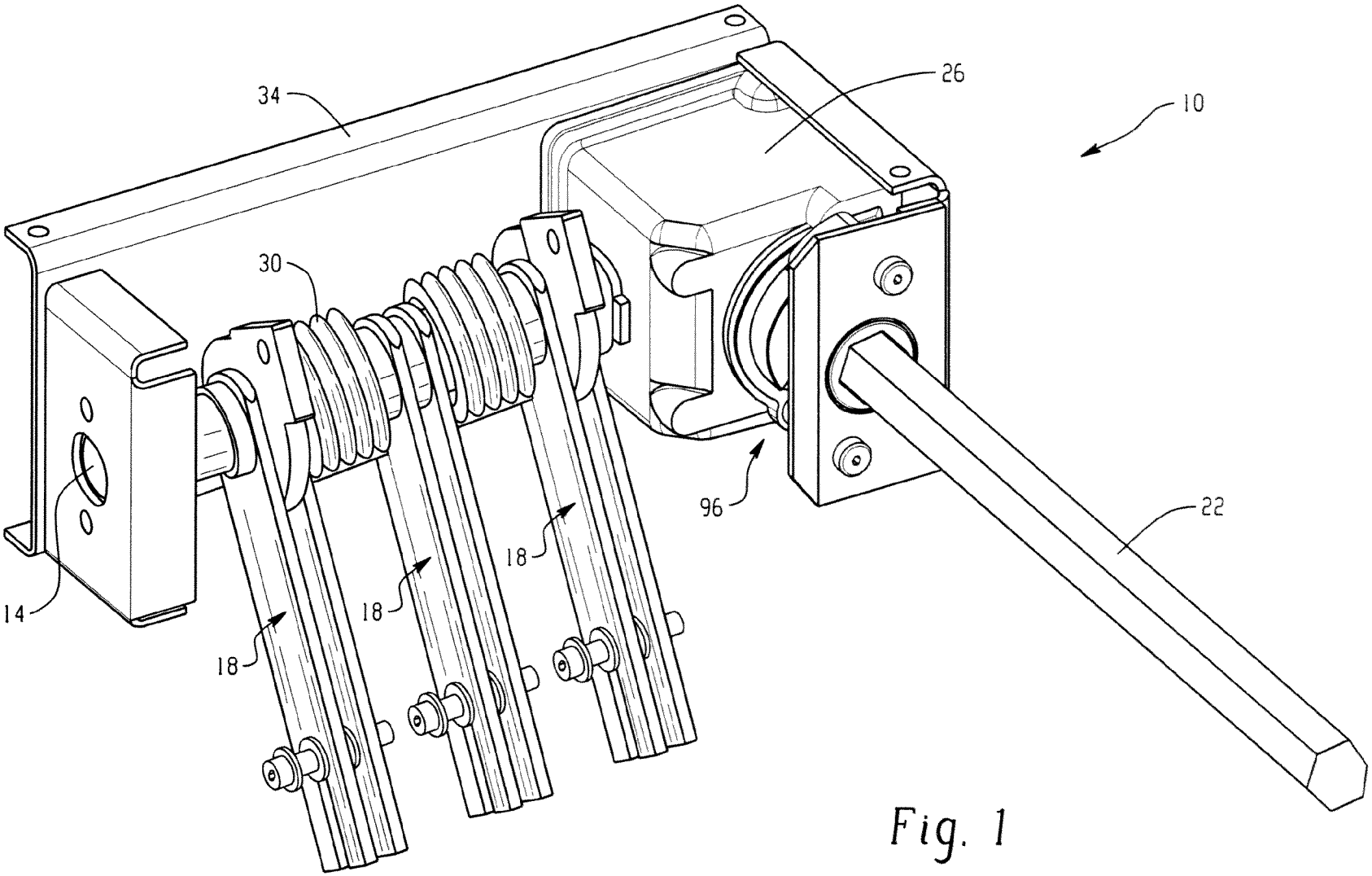
FIG. 1 is a perspective view of an exemplary earthing switch in accordance with the disclosure.

With reference to FIG. 1, an exemplary earthing switch 10 in accordance with the disclosure is illustrated. The earthing switch 10 generally includes a rotatable actuating shaft 14 on which a plurality of blade contacts 18 are mounted for rotation therewith between an open position and a closed position wherein said contacts 18 engage respective line/load stabs. An actuating mechanism, including an input shaft 22 and gearbox 26, is connected to the actuating shaft 14 for moving the blade contacts 18 between the open and closed positions. Unlike prior art earthing switches that utilize coil-over springs, the earthing switch 10 utilizes a torsion spring 30 arranged coaxially with the actuating shaft 14 for biasing the blade contacts 18 towards the closed position. This results in a compact design that can be easily scaled for various applications. All of the components are supported on a mounting bracket 34 that can be mounted to a desired surface, such as within an electrical cabinet or the like.

Figure 2:
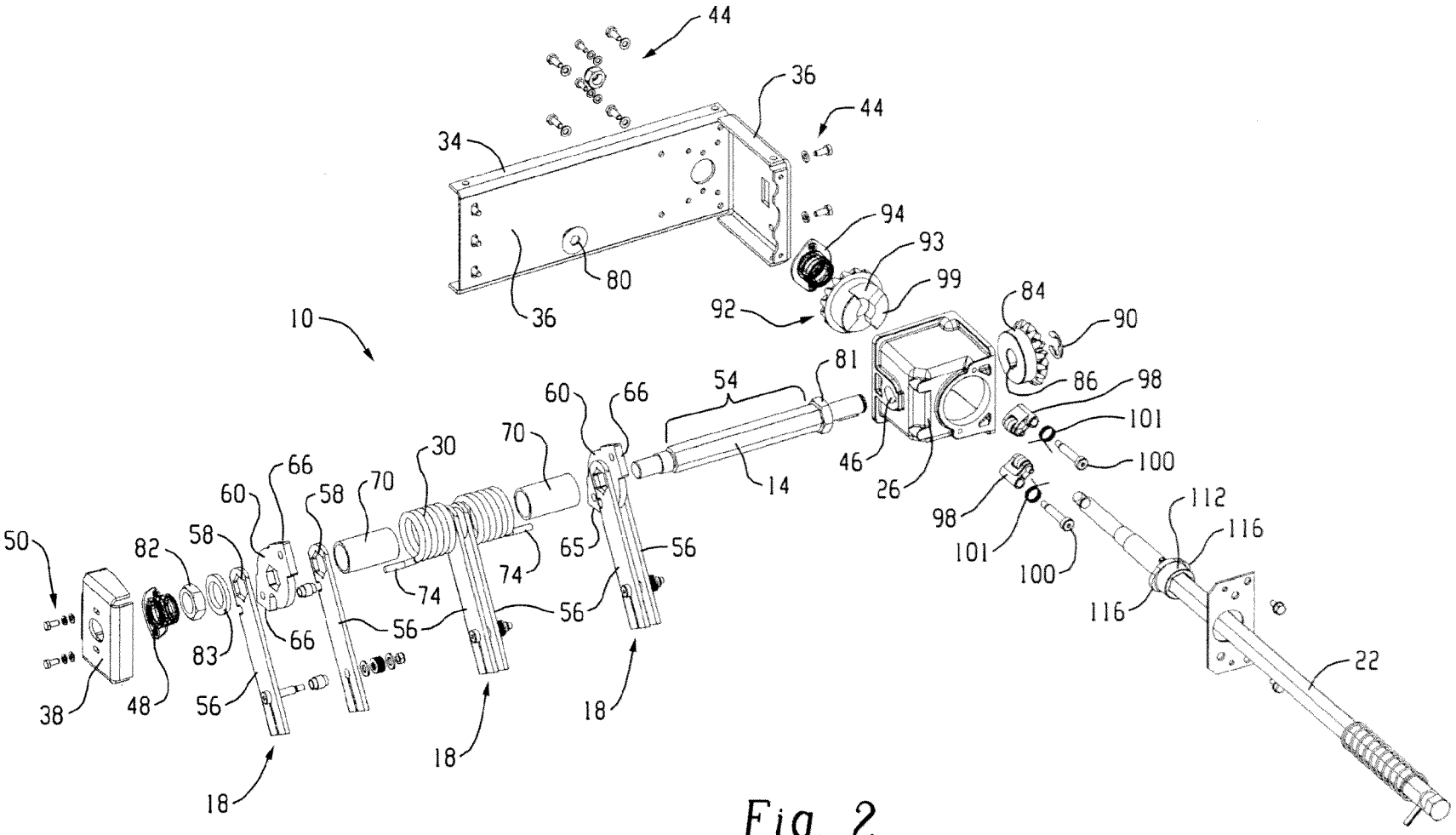
FIG. 2 is an exploded view of the exemplary earthing switch of FIG. 1.

With additional reference to FIG. 2, the details of the exemplary earthing switch 10 will be described. The mounting bracket 34 includes a base plate 36, a gear box end plate 38 secured to the base plate 36, and a shaft end plate 38 also secured to the base plate 36. The mounting bracket 34 includes a plurality of holes for securing the same to a desired surface using one or more suitable fasteners. The gear box 26 is secured to the base plate 36 and end plate 38 via a plurality of bolts 44. A first end of the actuating shaft 14 is received through an opening 46 in the gear box 26 and supported therein for rotation. A second end of the actuating shaft 14 is supported for rotation by a bearing 48 secured to the shaft end plate 38 by bolts 50.

The actuating shaft 14 includes a non-circular portion 54 thereof on which the plurality of blade contacts 18 are mounted. In the illustrated embodiment, the non-circular portion 54 of the actuating shaft 14 has a hexagonal cross-section, but other non-circular shapes could be used. Each blade contact 18 comprises a pair of individual blades 56, each having an opening 58 in an end thereof having a cross-sectional shape corresponding to the cross-sectional shape of the non-circular portion 54 of the actuating shaft 14. When received on the non-circular portion 54, each blade 56 is fixed for rotation with the actuating shaft 14.

The axially outer blade contacts 18 are mounted to the actuating shaft 14 with a ground spacer 60 disposed between each respective blade 56 at its point of attachment to the actuating shaft 14. Like each blade 56, each ground spacer 60 is keyed to the actuating shaft for rotation therewith. To this end, each ground spacer 60 has a central bore 62 having a cross-sectional shape that corresponds to the non-circular portion 54 of the actuating shaft. As will be described in more detail below, each ground spacer 60 also includes first and second radially extending ears 64 having stop surfaces 66 for limiting the extent of rotation of the actuating shaft 14. The stop surfaces 66 make contact with the baseplate 36 when the actuating shaft 14 is rotated a predetermined amount in either direction. Accordingly, the ground spacers 60 act as limiters to prevent over-rotation of the shaft 14.

Each ground spacer 60 further includes a bore 68 provided for connecting each ground spacer 60 to a grounding strap (not shown). The middle blade contact 18 has a spacer 69 between respective blades 56. The spacer 69 is not a ground spacer (e.g., it does not have a tab for connection to a ground strap), although a ground spacer could be utilized in that position as well if desired.

A pair of tubular spacers 70 are provided for locating and/or spacing the blade contacts 18 axially along the actuating shaft 14. The tubular spacers 70 also support the torsion spring 30 and, as such, can have an outer circumference that is closer in size to an inner circumference of the torsion spring 30 than is the outer circumference of the actuating shaft 14. Together, the actuating shaft and blade contact assembly including ground spacers 60, spacer 69, and spacers 70, define a conductive ground path from the blade contacts 18 to ground.

Figure 3:
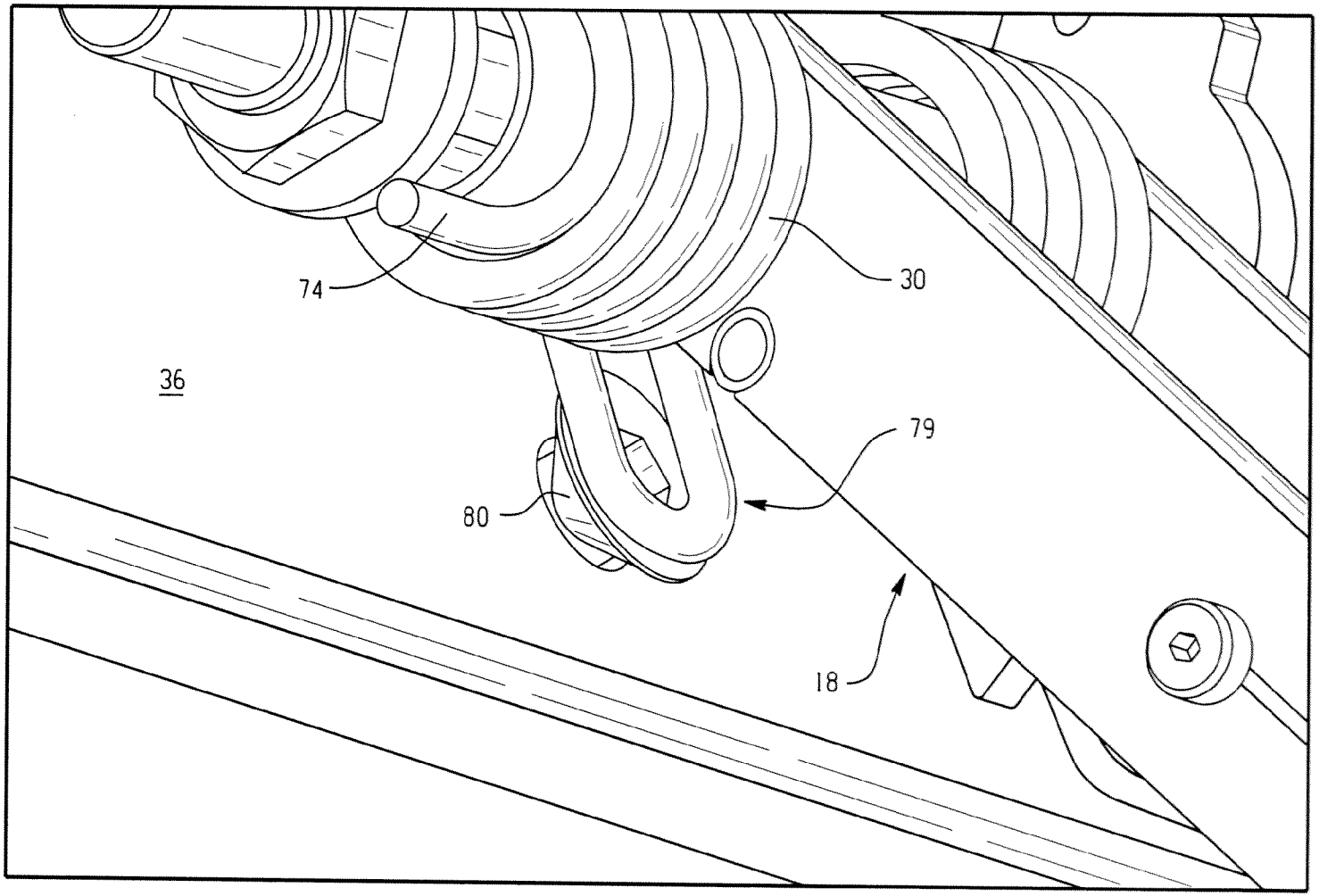
FIG. 3 is an enlarged view of the exemplary earthing switch of FIG. 1 showing details of the torsion spring.
Figure 4:
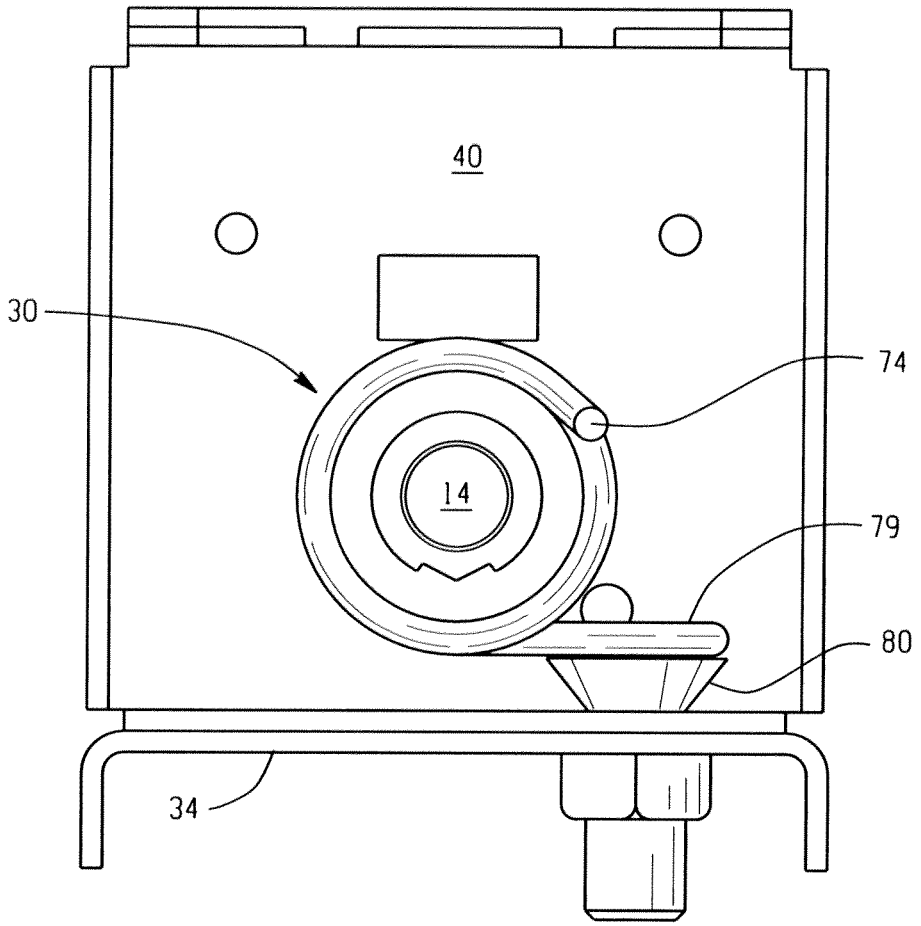
FIG. 4 is an side elevational view of the exemplary earthing switch showing the torsion spring and set screw for adjusting torsion spring tension.

Opposite tails 74 of the dual coil torsion spring 30 are received in spring holes 76 that secure the spring 30 to respective blade contacts 18. With reference to FIGS. 3 and 4, a central portion 78 of the spring 30 between respective coils includes tab 79. Tab 79 is a generally u-shape extension of the spring 30 that is configured to engage a set screw 80 mounted to the bracket 30 to thereby restrict rotation of the tab 79 relative to the bracket. Set screw 80 can be adjusted to adjust the tension (preload) of the torsion spring 30. For example, the set screw can be unscrewed from the position shown in FIGS. 3 and 4 thereby displacing the tab 79 upward and increasing the spring preload. In contrast, if the set screw is screwed in further from the position shown, the preload of the spring will be reduced.

All of the components mounted on the actuating shaft 14 are secured thereon between hex nut portion 81 at a first end of the shaft 14, and a hex nut 82 and washer 83 secured to the opposite end of the shaft 14. As will be appreciated, the actuating shaft and blade contact assembly can be configured using components of differing sizes to produce a switch having a desired size and/or rating. For example, the spacing between the individual blades 56 of the blade contacts 18 can be changed by utilizing ground spacers 60 having a desired thickness. Also, the orientation of the blade contacts 18 can be changed by locating each blade in a desired angular position on the non-circular portion 54 of the actuating shaft 14. Further, the spacing between each respective blade contact 18 can be altered by using spacers 70 of a desired length. In some cases, a given actuating shaft 14 can be used to support a plurality of configurations of the blade contacts 18, etc., thereon. In other instances, an actuating shaft having a longer or shorter axial length may be provided instead of the illustrated actuating shaft 14 to accommodate larger or smaller contact assemblies.

As noted, a first end of the actuating shaft 14 is received in the gear box 26 and supported therein for rotation. In this regard, a miter gear 84 is keyed to the end of the actuating shaft via a key 86 received in a keyway of the miter gear 84. In the illustrated embodiment, the miter gear is secured on the end of the actuating shaft 14 via a e-type circlip 90, but could be secured to the shaft 14 in any suitable manner.

Miter gear 84 is engaged with a corresponding miter gear 92 that is secured to an end of the input shaft 22 and supported for rotation on a bearing 94 that is secured to the base plate 36. As will be appreciated, rotation of the input shaft 22 results in rotation of the actuating shaft 14 and corresponding movement of the blade contacts 18, for example, between their open and closed positions. In order to maintain the switch in an open position against the bias of the torsion spring 30, miter gear 92 includes a contoured hub 93 that is part of a latching mechanism 96 designed to hold the switch in the open position.

The latching mechanism 96 (also referred to as a detent mechanism) includes a pair of roller pawls 98 adapted to engage and follow respective outer hub surfaces 99 of the contoured hub 93 in a manner that restricts rotation of the gear 92 from a position associated with the contacts 18 being in their open position. In other words, the latching mechanism 96 operates to latch the switch in the open position against the force applied by the torsion spring 30. Once dislodged from the open position, the latching mechanism 96 allows the torsion spring 30 to rotate the switch contacts 18 unimpeded to the closed position.

Figure 5:
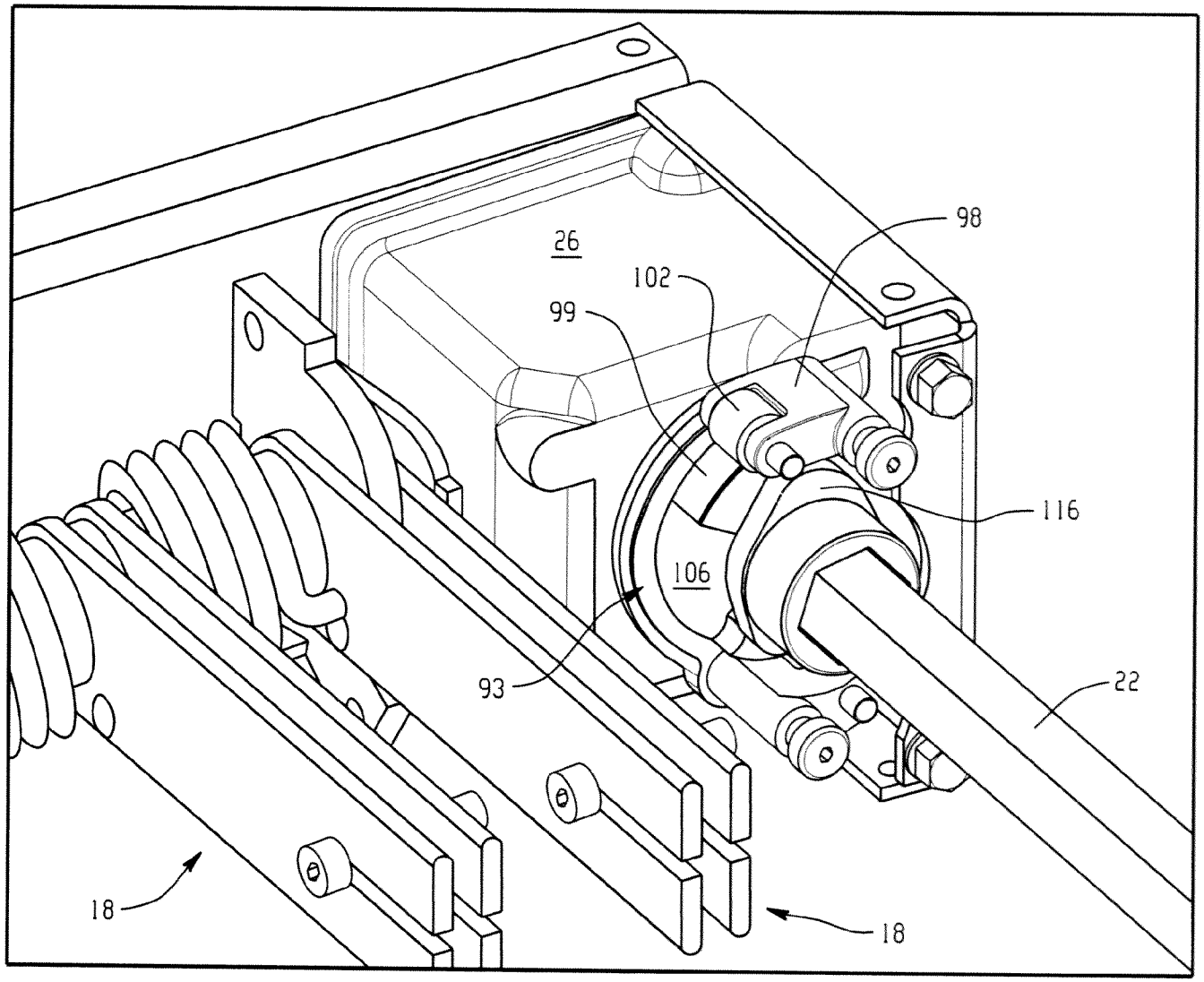
FIG. 5 is a perspective view of a latching mechanism of the exemplary earthing switch in a first position.
Figure 6:
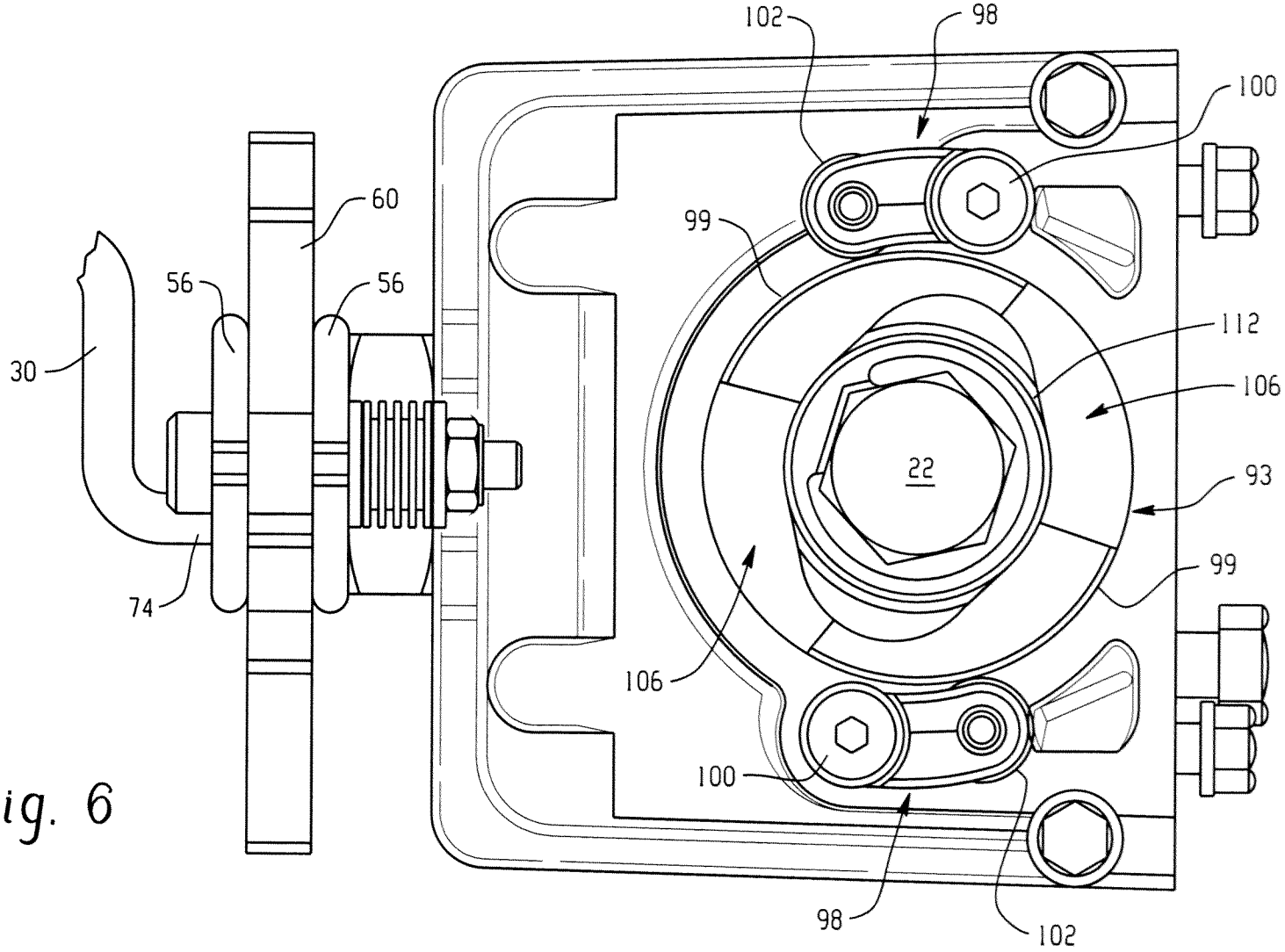
FIG. 6 is a front elevational view of the earthing switch in the position shown in FIG. 5.

Referring now to FIGS. 5 and 6, the latching mechanism 96 is shown in an unlatched position with the blade contacts 18 being in a closed or partially open position (e.g., not open). The outer hub surfaces 99 of the hub 93 extend from the gear box 26, with the miter gear 92 itself generally enclosed within the gear box 26. Each roller pawl 98 is pivotally mounted to the gear box 26 by a bolt 100, and is biased against the hub 93 via a pawl torsion spring 101 (FIG. 2). Rollers 102 of each roller pawl 98 engage respective hub surfaces 99 of the hub 93 at diametrically opposed positions.

As will be appreciated, the hub surfaces 99 are discontinuous and also diametrically opposed. Each hub surface 99 extends approximately ¼ of the circumference of the hub 93. In between the hub surfaces 99 are a pair of diametrically opposed recesses 106 in which the respective roller pawls 98 are adapted to reside when the switch is locked in the open position.

Figure 7:
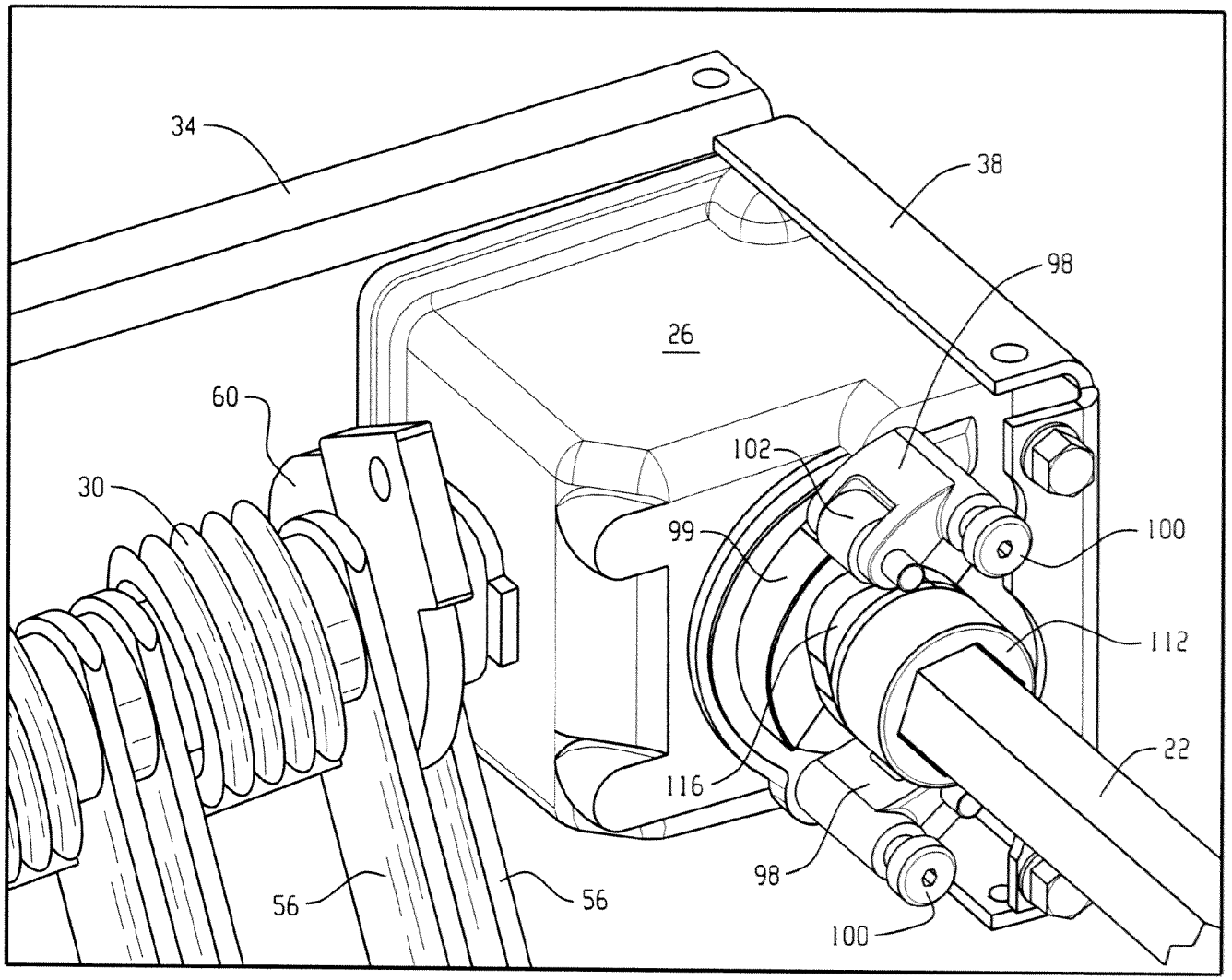
FIG. 7 is a perspective view of the exemplary earthing switch in a second position.
Figure 8:
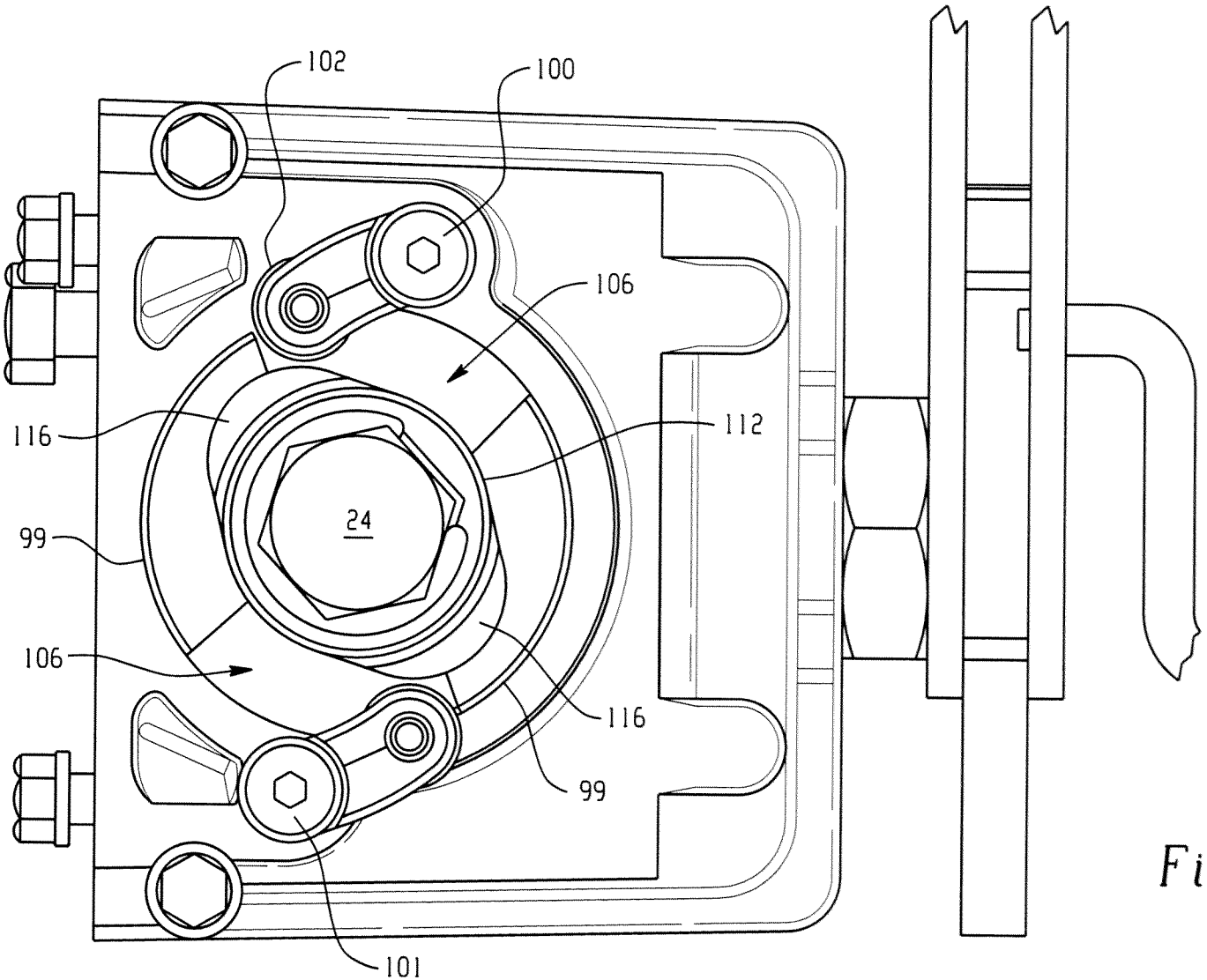
FIG. 8 is a front elevational view of the earthing switch in the position shown in FIG. 7.

With reference to FIGS. 7 and 8, it will be understood that the pawl torsion springs 101 (only shown in FIG. 2) bias the pawls 98 against the hub surfaces 99 such that, when input shaft 22 is rotated and the pawls 99 become aligned with the recesses 106, the pawls 98 will pivot radially inwardly into the recesses 106 and secure the switch in the open position against the bias of the torsion spring 30. Once in the position of FIGS. 7 and 8, the rollers 102 engage end surfaces 110 of the hub 93 and restrict rotation of the hub 93 and by extension the input shaft 24 and actuating shaft 14. In this position, the pawls 98 are in an "over-center" position with respect to their point of attachment to the housing 26 such that as the torsion spring 30 acts upon the actuating shaft 14 and thereby the hub 93, the pawls are further driven radially inwardly thereby preventing rotation of the hub 93 and latching the switch open.

To release the latching mechanism 96, a cam 112 is provided on the input shaft 22 and mounted for rotation therewith. Cam 112 has a pair of diametrically opposed cam lobes 116 adapted to urge the pawls 98 radially outwardly when the input shaft 22 is rotated from the position shown in FIGS. 7 and 8 (e.g., the switch open and latched position) towards a switch closed position (e.g., as shown in FIGS. 5 and 6). The cam lobes 116 are positioned radially about the input shaft 22 in a position such that they immediately engage and urge radially outwardly a surface of the pawls 98, for example the rollers 102, when the input shaft 22 is rotated from the open and latched position. As the shaft 22 is rotated, the cam lobes 116 radially displace the pawls 98 until the rollers 102 clear the end surfaces 110 at which point the pawls 98 no longer restrict rotation of the hub 93, and by extension the input shaft 24 and actuating shaft 14. Accordingly, the torsion spring 30 then can act to rapidly transition the switch to a closed position.

As will now be appreciated, the latching mechanism 96 enables the switch to be maintained in the open position against the force of the torsion spring 30 and then to quickly become unlatched and allow the full force of the torsion spring 30 to act upon the actuating shaft 14 to close the switch. This results in a rapid closure to avoid or minimize arcing issues that can sometimes occur when closing the switch against a fault.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An earthing switch for connecting a power source to ground comprising:

an actuating mechanism;

a rotatable shaft adapted to be rotated by the actuating mechanism;

at least one moveable contact secured to the rotatable shaft for rotation therewith, the at least one moveable contact moveable between an open position and a closed position via rotation of the rotatable shaft by the actuating mechanism;

a torsion spring for biasing the at least one moveable contact towards the closed position;

a detent mechanism for latching the at least one moveable contact in the open position;

and a mounting bracket;

wherein the rotatable shaft is supported on the mounting bracket for rotation, and wherein a coil of the torsion spring is received coaxially over the rotatable shaft, a first end of the torsion spring being fixed against rotation relative to said mounted bracket, and a second end of the torsion spring being operatively connected to the movable contact, whereby rotation of the rotatable shaft in a first direction is opposed by the torsion spring while rotation of the rotatable shaft in the second direction is assisted by the torsion spring.

2. An earthing switch as set forth in claim 1, further comprising a plurality of moveable contacts secured to the rotatable shaft for movement therewith, the moveable contacts being axially spaced apart along the shaft by at least one spacer.

3. An earthing switch as set forth in claim 2, wherein the at least one spacer is coaxially received over the rotatable shaft.

4. An earthing switch as set forth in claim 1, wherein the at least one moveable contact includes a pair of spaced apart blades adapted to receive a stab therebetween when in the closed position.

5. An earthing switch as set forth in claim 1, wherein the actuating mechanism includes a rotary actuating mechanism for rotating the shaft.

6. An earthing switch as set forth in claim 1, wherein the detent mechanism includes at least one pawl adapted to engage a surface of a hub associated with the actuating mechanism for latching the switch in an open position.

7. An earthing switch as set forth in claim 6, wherein the at least one pawl is pivotally mounted to a housing of the actuating mechanism for movement between a radially outer position and a radially inner position relative to the hub whereat the pawl is received in a recess in the hub.

8. An earthing switch as set forth in claim 7, further comprising a cam member for radially displacing the at least one pawl from its radially inner position, wherein the hub and cam are mounted coaxially on an input shaft of the actuating mechanism and whereby rotation of the input shaft from a position corresponding to a latched position of the switch towards a position corresponding to a closed position of the switch causes the cam to radially outwardly displace the at least one pawl from the recess and allow the switch to close.

9. An earthing switch for connecting a power source to ground comprising:

an actuating mechanism;

a rotatable shaft adapted to be rotated by the actuating mechanism;

a plurality of moveable contacts secured to the rotatable shaft for movement therewith between an open position and a closed position, the moveable contacts being axially spaced apart along the shaft by at least one spacer;

a torsion spring for biasing the at least one moveable contact towards the closed position; and a detent mechanism for latching the at least one moveable contact in the open position, wherein the at least one spacer is conductive.

10. A modular earthing switch assembly comprising:

a support member;

a rotatable shaft having a non-circular cross-section supported for rotation on said support member;

a moveable contact mountable on the rotatable shaft in a plurality of positions, the moveable contact having a bore with a non-circular cross-section for telescoping over the non-circular cross-section of the rotatable shaft thereby fixing the movable contact for rotation with the rotatable shaft;

at least one spacer received coaxially on the rotatable shaft and located adjacent the moveable contact, the at least one spacer axially locating the moveable contact along the rotatable shaft; and a torsion spring for biasing the movable contact towards a closed position.

11. A modular earthing switch as set forth in claim 10, further comprising a mounting bracket, wherein the rotatable shaft is supported on the mounting bracket for rotation, and wherein a coil of the torsion spring is received coaxially over the rotatable shaft, a first end of the torsion spring being fixed against rotation relative to said mounted bracket, and a second end of the torsion spring being operatively connected to the movable contact, whereby rotation of the rotatable shaft in a first direction is opposed by the torsion spring while rotation of the rotatable shaft in the second direction is assisted by the torsion spring.

12. A modular earthing switch as set forth in claim 10, wherein the at least one moveable contact includes a pair of spaced apart blades adapted to receive a stab therebetween when in the closed position.

13. A modular earthing switch as set forth in claim 10, further comprising an actuating mechanism for rotating the shaft to effect movement of the at least one movable member between an open position and a closed position.

14. A modular earthing switch as set forth in claim 13, further comprising a detent mechanism including at least one pawl adapted to engage a surface of a hub associated with the actuating mechanism for latching the switch in an open position.

15. A modular earthing switch as set forth in claim 14, wherein the at least one pawl is pivotally mounted to a housing of the actuating mechanism for movement between a radially outer position and a radially inner position relative to the hub whereat the pawl is received in a recess in the hub.

16. A modular earthing switch as set forth in claim 15, further comprising a cam member for radially displacing the at least one pawl from its radially inner position, wherein the hub and cam are mounted coaxially on an input shaft of the actuating mechanism, and whereby rotation of the input shaft from a position corresponding to a latched position of the switch towards a position corresponding to a closed position of the switch causes the cam to radially outwardly displace the at least one pawl from the recess.

* * * * *